US006438966B1

(12) United States Patent
Sarwinski et al.

(10) Patent No.: US 6,438,966 B1
(45) Date of Patent: Aug. 27, 2002

(54) CRYOCOOLER INTERFACE SLEEVE

(75) Inventors: Raymond E. Sarwinski; William E. Stonecipher, both of San Diego; Bruce C. Breneman, Rancho Santa Fe, all of CA (US)

(73) Assignee: Applied Superconetics, Inc., San Diego, CA (US)

( * ) Notice: Subject to any disclaimer, the term of this patent is extended or adjusted under 35 U.S.C. 154(b) by 0 days.

(21) Appl. No.: 09/881,642

(22) Filed: Jun. 13, 2001

(51) Int. Cl.[7] ..... F25B 9/00; F28F 7/00
(52) U.S. Cl. ..... 62/6; 62/259.2; 165/185
(58) Field of Search ..... 62/6, 259.2; 165/85

(56) References Cited

U.S. PATENT DOCUMENTS

| | | | | |
|---|---|---|---|---|
| 4,724,677 A | | 2/1988 | Foster | |
| 4,763,483 A | | 8/1988 | Olsen | |
| 4,956,974 A | | 9/1990 | Planchard | |
| 5,025,632 A | | 6/1991 | Spritzer | |
| 5,412,363 A | | 5/1995 | Breneman | |
| 5,682,751 A | * | 11/1997 | Langhorn et al. | 62/51.1 |
| 5,966,944 A | | 10/1999 | Inoue | |
| 6,038,867 A | * | 3/2000 | Einziger et al. | 62/45.1 |
| 6,256,999 B1 | * | 7/2001 | Chase | 62/6 |
| 6,305,174 B1 | * | 10/2001 | Binneberg et al. | 62/6 |

OTHER PUBLICATIONS

Bitterman et al., Pulse Tubes Gain Foothold in Cryocooler Markets, Superconductor & Cryoelectronics, Spring 1998, pp. 12–18.

* cited by examiner

*Primary Examiner*—William C. Doerrler
(74) *Attorney, Agent, or Firm*—Nydegger & Associates

(57) ABSTRACT

A sleeve assembly for thermally interconnecting a pulse tube, two stage cryocooler with a superconducting device includes a heat transfer cylinder, a heat transfer receptacle and a wall extending therebetween to define a passageway. The heat transfer receptacle is formed with a tapered recess wherein a tapered cooling probe of the cryocooler is urged against the heat transfer receptacle to establish thermal communication therebetween. A cooling element of the cryocooler is disposed in the heat transfer cylinder to establish thermal communication therebetween. In operation, the cryocooler moves relative to the sleeve assembly between a first configuration wherein the cryocooler is engaged with the sleeve assembly to establish thermal communication therebetween and a second configuration wherein the cryocooler is disengaged with the sleeve assembly. An expandable bellows which interconnects the cryocooler with the sleeve assembly will maintain thermal insulation therebetween when the cryocooler is disengaged from the sleeve assembly.

17 Claims, 2 Drawing Sheets

CRYOCOOLER INTERFACE SLEEVE

FIELD OF THE INVENTION

The present invention pertains generally to coupling assemblies for thermally connecting a cryocooler with an apparatus that is to be cooled. More particularly, the present invention pertains to a sleeve assembly which thermally interconnects two stages of a cryocooler with two different components of a superconducting device simultaneously. The present invention particularly, though not exclusively, pertains to a sleeve assembly which allows for the disengagement of a pulse tube, two stage cryocooler from a superconducting device during servicing of the cryocooler without compromising the thermal condition of the superconducting device.

BACKGROUND OF THE INVENTION

It is well known that superconductivity is accomplished at extremely low temperatures. Even the so-called high temperature superconductors require temperatures which are as low as approximately twenty degrees Kelvin. Other not-so-high temperature superconductors require temperatures which are as low as approximately four degrees Kelvin.

In any case, there are numerous specialized applications for using superconducting devices that require low temperatures. One specialized application, for example, involves medical diagnostic procedures using magnetic resonance imaging (MRI) techniques. When used for medical diagnosis, MRI techniques require the production of a very strong and substantially uniform magnetic field. If superconducting magnets are used to generate this strong magnetic field, some type of refrigeration apparatus will be required to attain the low operational temperatures that are necessary.

To attain the low operational temperatures that are necessary for a superconducting device, the refrigeration apparatus typically includes separate cryogenic units or cryocoolers that are thermally connected with the superconducting device. During operation of the superconducting device, such a connection is essential. There are times, however, when it is desirable for the cryocooler to be selectively disconnected or disengaged from the superconducting device. For example, during repair or routine maintenance of the cryocooler in a refrigeration apparatus, it is much easier to work on the cryocooler when it is disconnected from the superconducting device it has been cooling. Importantly, when so disengaged, the cryocooler can be warmed to room temperature for servicing. Any disengagement of the cryocooler from the superconducting device, however, must allow for a reengagement. Further, it is desirable that the superconducting device be held at a very low temperature during disengagement.

As it is known to persons skilled in the pertinent art, new generation cryocoolers, such as "Pulse Tubes", cannot be "gutted" out and rebuilt as can the older generation cryocoolers. Instead, these pulse tube cryocoolers must either be entirely replaced or warmed to room temperature for servicing. It is, therefore, necessary for these new generation cryocoolers to use a refrigeration apparatus or a sleeve to cool a superconducting device. Because the entire pulse tube needs to be removed for servicing, the pulse tube cryocoolers cannot be directly and permanently bolted to the sleeve and, thus, the superconducting device. Further, the pulse tube internals cannot be removed independently as they can in many Gifford McMahon (GM) two stage cryocoolers.

For an effective thermal connection, it is known that the efficacy of heat transfer from one body to another body is dependent on several factors. More specifically, the amount of heat (Q) that is conductively transferred through a solid body or conductively transferred from one body to another body through a gas or liquid can be mathematically expressed as:

$$Q=k(A/L)\Delta T$$

In the above expression, k is the coefficient of thermal conductivity; A is the solid bodies cross-sectional area, or the surface area in contact between the two bodies for gas or liquid conduction; L is the solid bodies thermal length or the gap distance between the bodies; and ΔT is the temperature differential across the solid or between the two bodies. From this expression, it can be appreciated that in order to effectively cool one body (e.g. a superconducting device) with another body (e.g. a cryocooler) the transfer of heat, Q, must be accomplished. When the temperature differential between the bodies is desired to be very low, and for a given coefficient of thermal conductivity, it is necessary that the ratio of A/L be sufficiently high.

For any two separate bodies that are in contact with each other, even though they may be forced together under very high pressures, there will always be some average gap distance, L, between the interfacing cross-sectional surface areas of the bodies. For the case wherein there is a vacuum in the gaps, the gaps can create undesirable thermal insulators. Accordingly, it may be beneficial to have these gaps filled with a gas, such as helium. If this is done, heat transfer between the bodies in contact can result from a) solid conduction where there is actual contact between the bodies; b) molecular/gas conduction across the helium-filled gaps; and possibly c) liquid conduction in gaps where the gas has liquefied.

In light of the above, it is an object of the present invention to provide an interface sleeve between two stages of a pulse tube cryocooler and two components of a superconducting device which allows the two stages of the cryocooler to be thermally engaged and disengaged simultaneously from the two components of the superconducting device. Another object of the present invention is to provide an interface sleeve between a pulse tube, two stage cryocooler and a superconducting device that allows the cryocooler to be serviced at room temperature while the very low temperature of the superconducting device is substantially maintained. Still another object of the present invention is to provide an interface sleeve between a pulse tube, two stage cryocooler and a superconducting device which is effectively easy to use, relatively simple to manufacture and comparatively cost effective.

SUMMARY OF THE PREFERRED EMBODIMENTS

The present invention is directed to a sleeve assembly which thermally interconnects a pulse tube, two stage cryocooler with a superconducting device. Specifically, the sleeve assembly of the present invention has a heat transfer cylinder, a heat transfer receptacle and a midsection which interconnects the heat transfer cylinder with the heat transfer receptacle.

In more detail, the midsection of the sleeve assembly is hollow and elongated and defines a passageway between the heat transfer cylinder and the heat transfer receptacle. The heat transfer cylinder of the present invention is also hollow and is annular-shaped, having an inner surface and an outer surface. The heat transfer receptacle is formed with a recess and has an inner surface and an outer surface. Importantly, the inner surface of the heat transfer receptacle that defines the recess is tapered. Both the heat transfer cylinder and heat transfer receptacle are preferably made of copper, aluminum or any other high thermal conductivity material. Furthermore, the midsection of the sleeve assembly is preferably made of stainless steel or any other low thermal conductivity material known in the art.

The structure of the sleeve assembly is dimensioned for the engagement with a cryocooler which includes a cooling element and a tapered cooling probe. As contemplated for the present invention, the cryocooler is moveable relative to the sleeve assembly between a first configuration wherein the cryocooler is engaged with the sleeve assembly, and a second configuration wherein the cryocooler is disengaged from the sleeve assembly. Specifically, the two stages of the cryocooler will thermally engage and disengage with the two components of the superconducting device simultaneously through the sleeve assembly.

In more detail, the sleeve assembly is engaged with the cryocooler when the tapered cooling probe of the cryocooler is urged against the heat transfer receptacle of the sleeve assembly to establish thermal communication therebetween. As stated above, the inner surface of the heat transfer receptacle is tapered for mating engagement with the tapered cooling probe of the cryocooler. This engagement, however, will not be perfect. Always, there is an average gap distance between the inner surface of the heat transfer receptacle and the tapered cooling probe of the cryocooler. As contemplated for the present invention, this gap distance varies within the range between zero and approximately two thousandths of an inch (0–0.002 inches). Importantly, under these conditions, the area to gap distance ratio, A/L, in the above expression for Q will be in the range between approximately 10,000 $in^2/in$ to approximately 200,000 $in^2/in$. Consequently, there can be effective heat flow, Q, even though the $\Delta T$ between the heat transfer receptacle and the tapered cooling probe is small.

When the cryocooler is engaged with the sleeve assembly (first configuration), the cooling element of the cryocooler is positioned at a very small gap distance from the inner surface of the heat transfer cylinder. Importantly, this gap distance needs to be small enough to establish effective thermal communication between the cooling element and the heat transfer cylinder. For the present invention, this gap distance will vary within the range between approximately one thousandth of an inch to approximately five thousandths of an inch (0.001–0.005 inches). Although the area to gap distance ratio, A/L, in this case will be higher than it is for the receptacle/probe interface, there will still be effective heat flow, Q.

In order for the cryocooler and sleeve assembly to move between the first (engaged) and second (disengaged) configurations, an expandable bellows is provided which interconnects the heat transfer cylinder of the sleeve assembly with the room temperature section of the cryocooler and creates an enclosed chamber therebetween. In operation, the bellows allows the cryocooler to be separated from the sleeve assembly with a space therebetween which will maintain a gaseous thermal insulation between the cryocooler and the sleeve assembly. Stated another way, there will be sufficient thermal insulation between the sleeve assembly and the cryocooler to maintain the sleeve assembly at a substantially same low temperature when the cryocooler is disengaged from the sleeve assembly and is warmed to room temperature.

It is important for the sleeve assembly to maintain two substantially low temperatures for it to continually cool the two separate components of the superconducting device. To do this, the sleeve assembly of the present invention is operationally connected to the superconducting device by a proximal conductor and a distal conductor. In more detail, the proximal conductor is attached between the outer surface of the heat transfer cylinder and a sheath of the superconducting device to establish thermal communication therebetween. Further, the distal conductor is attached between the outer surface of the heat transfer receptacle and the superconducting wires of the superconducting device to establish thermal communication therebetween.

A helium source is also connected to the sleeve assembly of the present invention. By way of a pipe, the helium source will pump helium gas into the sleeve assembly. As contemplated for the present invention, the introduction of helium gas into the space between the cryocooler and the sleeve assembly will prevent a vacuum from forming when the cryocooler is disengaged and displaced from the sleeve assembly. Importantly, helium gas is useful to establish molecular conduction between the sleeve assembly and the cryocooler for an effective thermal connection therebetween when these two components are engaged with each other.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENT

Figure 1:
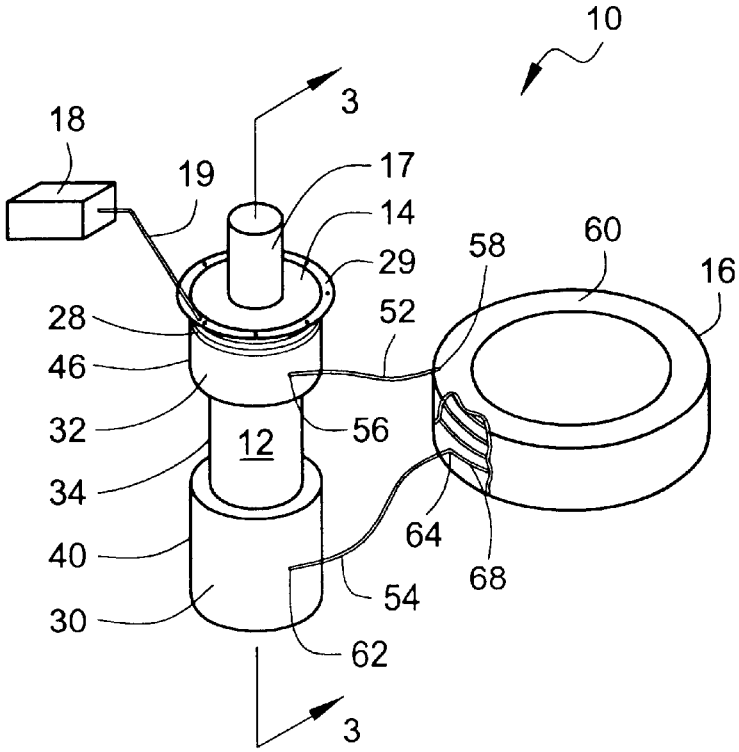
FIG. 1 is a schematic, perspective view of the sleeve assembly of the present invention engaged with a pulse tube, two stage cryocooler and shown operationally connected to a superconducting device, with portions broken away for clarity.

Referring initially to FIG. 1, a cooling system according to the present invention is shown and generally designated 10. More specifically, the cooling system 10 includes a sleeve assembly 12 which thermally interconnects a pulse tube, two stage cryocooler 14 with a superconducting device 16. As also shown, a helium source 18 is connected via a pipe 19 to the sleeve assembly 12. As intended for the present invention, the sleeve assembly 12 allows for thermally connecting and disconnecting the cryocooler 14 from the superconducting device 16.

Figure 2:
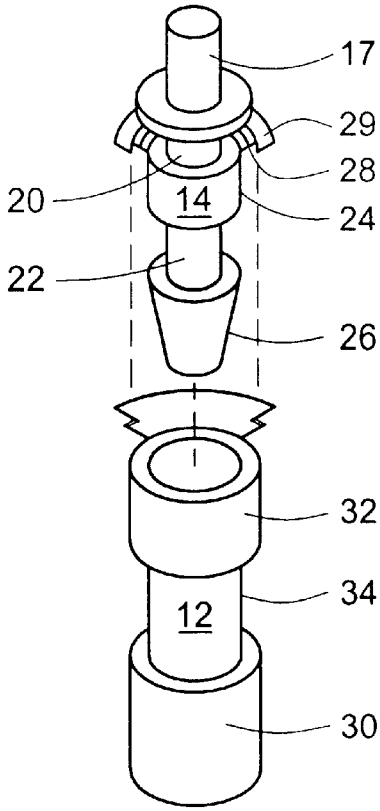
FIG. 2 is a perspective exploded view showing the sleeve assembly of the present invention in its structural relationship with a pulse tube, two stage cryocooler.

As shown in FIG. 2, the pulse tube, two stage cryocooler 14 has a valve motor body 17 having a first stage 20 (first cryocooler station) that is aligned with a second stage 22 (second cryocooler station). A cooling element 24 is disposed between the stages 20 and 22. Importantly, the cooling element 24 is in thermal communication with the first stage 20. As shown, a tapered cooling probe 26 extends from the second stage 22 and is in thermal communication with the second stage 22. As intended for the present invention, the second stage 22 maintains a temperature of approximately four degrees Kelvin (4° K) and cools the tapered cooling probe 26 to substantially that same low temperature. Further, the first stage 20 maintains a temperature of approximately forty degrees Kelvin (40° K) and cools the cooling element 24 to substantially that same temperature. Preferably, the cooling element 24 and the tapered cooling probe 26 of the cryocooler 14 can be both made of copper, aluminum or any other known high thermal conductivity material. A bellows 28 having a flange 29 is shown attached, with the flange 29, to the cryocooler 14. The pipe 19 that interconnects the helium source 18 with the sleeve assembly 12 is attached through the bellows flange 29 as shown in FIG. 1.

Still referring to FIG. 2, it will be seen that the sleeve assembly 12 includes a heat transfer receptacle 30, a heat transfer cylinder 32 and a midsection 34 which interconnects the heat transfer receptacle 30 with the heat transfer cylinder 32. It is important for the heat transfer receptacle 30 to be dimensioned to receive the tapered cooling probe 26 of the cryocooler 14. Similarly, the heat transfer cylinder 32 is dimensioned to receive the cooling element 24 of the cryocooler 14. The details of the structure of the sleeve assembly 12 can perhaps be best seen in FIGS. 3A and 3B.

Figure 3A:
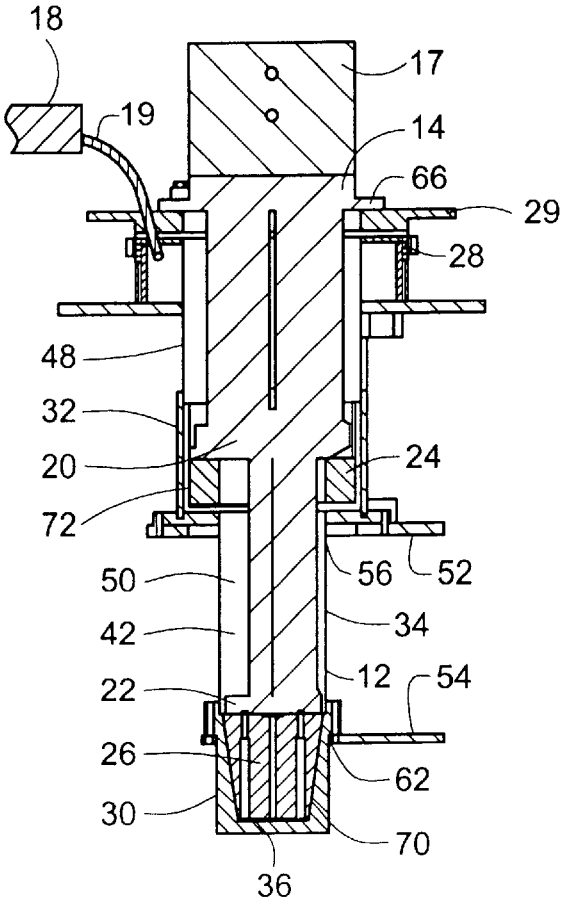
FIG. 3A is a cross-sectional view of the sleeve assembly and pulse tube, two stage cryocooler operationally engaged with each other as would be seen along the line 3—3 in FIG. 1.
Figure 3B:
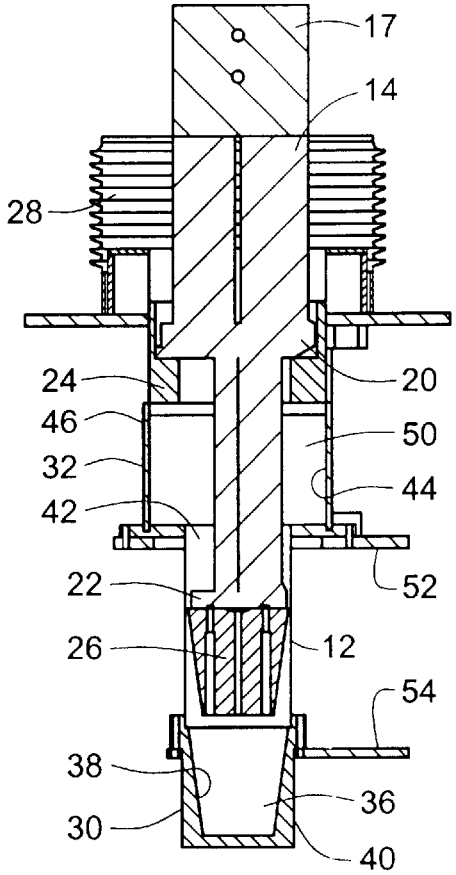
FIG. 3B is a cross-sectional view of the sleeve assembly and pulse tube, two stage cryocooler as seen in FIG. 3A when they are operationally disengaged from each other for the purposes of servicing the cryocooler.

In FIGS. 3A and 3B, the heat transfer receptacle 30 of the sleeve assembly 12 is shown formed with a recess 36. As best seen in FIG. 3B, the heat transfer receptacle 30 has an inner surface 38 and an outer surface 40. Importantly, the inner surface 38 of the heat transfer receptacle 30 that defines the recess 36 is tapered. As also shown in FIGS. 3A and 3B, the midsection 34 of the sleeve assembly 12 is hollow and elongated, and it defines a passageway 42 between the heat transfer receptacle 30 and the heat transfer cylinder 32. The heat transfer cylinder 32 is also hollow and is annular-shaped, having an inner surface 44 and an outer surface 46. Preferably, the heat transfer receptacle 30 and the heat transfer cylinder 32 can be made of copper, aluminum or any other high thermal conductivity material. The midsection 34 of the sleeve assembly 12 can be made of stainless steel or any other low thermal conductivity material.

Referring back to FIG. 1, the sleeve assembly 12 is shown connected to two components of the superconducting device 16 by a proximal conductor 52 and a distal conductor 54. In more detail, the proximal conductor 52 has a first end 56 and a second end 58 and the distal conductor 54 also has a first end 62 and a second end 64. The first end 56 of the proximal conductor 52 is attached to the outer surface 46 of the heat transfer cylinder 32 and the second end 58 is attached to the thermal shield 60 of the superconducting device 16 as shown in FIG. 1. Similarly, the first end 62 of the distal conductor 54 is attached to the outer surface 40 of the heat transfer receptacle 30 and the second end 64 is attached to the superconducting wires 68 of the superconducting device 16 as shown in FIG. 1.

As shown in FIG. 3A, the flange 29 of expandable bellows 28 interconnects the heat transfer cylinder 32 of the sleeve assembly 12 with a room temperature flange 66 of cryocooler 14. With this interconnection, an enclosed chamber 50 is created by the bellows 28 between the sleeve assembly 12 and the cryocooler 14 (see FIG. 3B). Also, an elongated, thin, stainless steel tube 48 is disposed between the bellows 28 and the heat transfer cylinder 32. Helium gas is pumped from the helium source 18 through the bellows flange 29 and into the chamber 50. Importantly, the bellows 28, with helium gas present in the chamber 50, creates an air-lock seal between the sleeve assembly 12 and the cryocooler 14 that isolates the cryocooler 14 from the superconducting device 16 whenever the cryocooler 14 is disengaged from the sleeve assembly 12.

The cooperation of the sleeve assembly 12 of the present invention and the cryocooler 14 can perhaps be best appreciated by cross referencing FIGS. 3A and 3B. Specifically, the cryocooler 14 is moveable relative to the sleeve assembly 12 between a first configuration wherein the cryocooler 14 is engaged with the sleeve assembly 12 (FIG. 3A) and a second configuration wherein the cryocooler 14 is disengaged with the sleeve assembly 12 (FIG. 3B). Importantly, the first stage 20 and the second stage 22 of the cryocooler 14 engage and disengage simultaneously with the sleeve assembly 12. It is to be appreciated that when the cryocooler 14 is engaged with the sleeve assembly 12, the area to gap distance ratio, A/L, is very big. Specifically, when there is an engagement, the A/L is typically in the range between approximately 10,000 $in^2/in$ to approximately 50,000 $in^2/in$ and, thus, there is a very small temperature differential $\Delta T$. When the cryocooler 14 is disengaged from the sleeve assembly 12, the A/L will be in the range between approximately 10 $in^2/in$ to approximately 50 $in^2/in$. In this case where A/L is small, the $\Delta T$ is very big and, as a result, the transfer of heat, Q, is effectively not accomplished.

FIG. 3A shows the tapered cooling probe 26 of the cryocooler 14 urged against the recess 36 of the heat transfer receptacle 30 to establish thermal communication therebetween. As mentioned above, the heat transfer receptacle 30 is tapered for mating engagement with the tapered cooling probe 26 with a gap distance 70 between all of their respective interfacing surfaces. In general, this gap distance 70 between the tapered cooling probe 26 and the inner surface 38 of the heat transfer receptacle 30 may vary within a range between zero and approximately two thousandths of an inch (0–0.002 inches). Importantly, helium molecular/gas or liquid conduction is established through gap distance 70. FIG. 3A also shows that the cooling element 24 of the cryocooler 14 positioned at a very small gap distance 72 from the inner surface 44 of the heat transfer cylinder 32. It is important for this gap distance 72 to be small enough to establish effective molecular/gas conduction through helium gas between the cooling element 24 and the heat transfer cylinder 32. On the other hand, there needs to be sufficient gap distance 72 for the cooling element 24 to be inserted into the heat transfer cylinder 32. As contemplated for the present invention, this gap distance 72 will vary within a range between approximately one thousandth of an inch to approximately five thousandths of an inch (0.001–0.005 inches).

FIG. 3B shows the cryocooler 14 disengaged from the sleeve assembly 12. The bellows 28 allows the cryocooler 14 to be separated from the sleeve assembly 12. There will be sufficient thermal insulation between the sleeve assembly 12 and the cryocooler 14 to maintain the sleeve assembly 12 at a substantially same low temperature when the cryocooler 14 is disengaged from the sleeve assembly 12. Meanwhile, the sleeve assembly 12 will remain in thermal communication with the superconducting device 16.

OPERATION

In the operation of the sleeve assembly 12 of the present invention, reference is first made to FIG. 2 wherein the pulse tube, two stage cryocooler 14 is shown being disposed in the sleeve assembly 12. In more detail, as shown in FIG. 3B, the tapered cooling probe 26 of the cryocooler 14 is passed through the passageway 42 of the sleeve assembly 12 and is inserted into the recess 36 of the heat transfer receptacle 30 as shown in FIG. 3A. The cryocooler 14 is placed in the sleeve assembly 12 and is bolted to the bellows flange 29. When the tapered cooling probe 26 contacts the heat transfer receptacle 30, the second stage 22 of the cryocooler 14 is disposed in the passageway 42 of the sleeve assembly 12. Furthermore, the cooling element 24 of the cryocooler 14 is disposed in the heat transfer cylinder 32 of the sleeve assembly 12. Importantly, when the cryocooler 14 is engaged with the sleeve assembly 12, the A/L is very big. Specifically, A/L is typically in the range between approximately 10,000 $in^2/in$ to approximately 50,000 $in^2/in$ and therefore, the temperature differential, $\Delta T$, between the cryocooler 14 and the sleeve assembly 12, is very small.

As shown in FIG. 1, the superconducting device 16 is in thermal communication with the sleeve assembly 12 which, in turn, is in thermal communication with the cryocooler 14. Stated differently, thermal communication is established between the cryocooler 14 and the superconducting device 16 through the sleeve assembly 12. In more detail, via the distal conductor 54, the tapered cooling probe 26 will cool the superconducting wires 68 of the superconducting device 16 to approximately four degrees Kelvin (4° K). Similarly, via the proximal conductor 52, the cooling element 24 of the cryocooler 14 will cool the thermal shield 60 of the superconducting device 16 to approximately forty degrees Kelvin (40° K).

During engagement or disengagement of the cryocooler 14 with the sleeve assembly 12, helium gas is pumped into the sleeve assembly 12 to establish molecular conduction between the cryocooler 14 and the sleeve assembly 12 through gap distances 70 and 72. Importantly, helium gas allows the three orders in magnitude difference in the A/L to act like a switch. This switch operation, therefore, allows for the engaging and disengaging between the cryocooler 14 and the sleeve assembly 12, as desired.

To disengage the cryocooler 14 from the sleeve assembly 12 and to disconnect thermal communication therebetween, the cryocooler 14 is lifted from the sleeve assembly 12 by any mechanical means known in the art. The cryocooler 14, however, is not removed from the sleeve assembly 12. Instead, the cryocooler 14 is lifted just enough to thermally disconnect the cryocooler 14 from the sleeve assembly 12. It is important to note that when the cryocooler 14 is lifted from the sleeve assembly 12, the first stage 20 and the second stage 22 are simultaneously disengaged from their respective positions in the sleeve assembly 12, which, in turn, are simultaneously disengaged with their respective thermal communication with the superconducting device 16.

Upon thermal disengagement between the cryocooler 14 and the sleeve assembly 12, it is important to appreciate that the A/L between the two bodies becomes very small. Specifically, A/L is in the range between approximately 10 $in^2/in$ to approximately 50 $in^2/in$. As a result, $\Delta T$ is very big, and the transfer of heat is relatively insignificant.

As indicated above, the bellows 28 interconnects the cryocooler 14 with the sleeve assembly 12 to create a chamber 50 therebetween. Other than the bellows 28, there is no other mechanical connection between the sleeve assembly 12 and the cryocooler 14. Importantly, when the cryocooler 14 is disengaged from the sleeve assembly 12, A/L goes from being very large (approximately 10,000 $in^2/in$—approximately 50,000 $in^2/in$) to very small (approximately 10 $in^2/in$—approximately 50 $in^2/in$). As a result of this, thermal insulation is created. Furthermore, the bellows 28 maintains sufficient thermal insulation between the cryocooler 14 and the sleeve assembly 12 for the sleeve assembly 12 to maintain its substantially same low temperature.

Upon thermal disconnection between the cryocooler 14 and the sleeve assembly 12, the cryocooler 14 can be warmed to room temperature for servicing. Meanwhile, the sleeve assembly 12 will remain in thermal communication with the superconducting device 16. Importantly, the superconducting device 16 will tend to maintain its cold temperature during disengagement (i.e. 4° Kelvin for the superconducting wires and 40° K for the thermal shield).

When the cryocooler 14 is disengaged from the sleeve assembly 12 for servicing, the cryocooler 14 will tend to expand as it is warmed to room temperature. It is, therefore, necessary to recool the cryocooler 14 prior to reengaging the cryocooler 14 with the sleeve assembly 12 in order for the cryocooler 14 to fit into the sleeve assembly 12. To do this, the stages 20 and 22 of the cryocooler 14 will cool the tapered cooling probe 26 and the cooling element 24 respectively and to their respective low temperatures. The cooled cryocooler 14 is then reengaged with the sleeve assembly 12 to establish thermal communication therebetween.

While the particular Cryocooler Interface Sleeve as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A sleeve assembly for receiving a cryocooler having a cooling element and a tapered cooling probe which comprises:

a heat transfer cylinder;

a heat transfer receptacle formed with a recess;

a midsection interconnecting said heat transfer cylinder with said heat transfer receptacle to define a passageway therebetween;

a means for moving said cryocooler relative to said sleeve assembly between a first configuration wherein said sleeve assembly is engaged with said cryocooler, with said tapered cooling probe urged against said heat transfer receptacle to establish thermal communication therebetween and with said cooling element of said cryocooler positioned in said heat transfer cylinder to establish thermal communication therebetween to set a temperature for said sleeve assembly, and a second configuration wherein said cryocooler is disengaged from said sleeve assembly; and a means for interconnecting said heat transfer cylinder with said cryocooler to create an enclosed space between said cryocooler and said sleeve assembly for effectuating thermal insulation therebetween to maintain said sleeve assembly at substantially said temperature when said sleeve assembly is in said second configuration.

2. A sleeve assembly as recited in claim 1 wherein said heat transfer receptacle comprises an inner surface and an outer surface with said inner surface defining said recess and being tapered for mating engagement with said tapered cooling probe with a distance therebetween, and further wherein said distance between said inner surface of said heat transfer receptacle and said tapered cooling probe of said cryocooler varies within a range between zero and approximately two thousandths of an inch (0–0.002 inches).

3. A sleeve assembly as recited in claim 1 wherein said heat transfer cylinder comprises an inner surface and an outer surface, and wherein said cooling element of said cryocooler is positioned at a distance from said inner surface of said heat transfer cylinder, and further wherein said distance is in a range between approximately one thousandth of an inch to approximately five thousandths of an inch (0.001–0.005 inches).

4. A sleeve assembly as recited in claim 1 wherein said heat transfer receptacle and said heat transfer cylinder are made of copper.

5. A sleeve assembly as recited in claim 1 wherein said midsection is made of stainless steel.

6. A sleeve assembly as recited in claim 1 wherein said cooling element and said tapered cooling probe are made of copper.

7. A sleeve assembly as recited in claim 1 further comprising:

a distal conductor having a first end and a second end, with said first end being attached to said outer surface of said heat transfer receptacle and said second end being attached to a wire of a superconducting device to establish thermal communication therebetween; and a proximal conductor having a first end and a second end, with said first end being attached to said outer surface of said heat transfer cylinder and said second end being attached to a thermal shield of said superconducting device to establish thermal communication therebetween.

8. A sleeve assembly as recited in claim 1 wherein said interconnecting means for maintaining thermal insulation is a bellows, and wherein said bellows is attached to said heat transfer cylinder proximal to said midsection.

9. A sleeve assembly as recited in claim 1 further comprising:

a helium source; and a pipe interconnecting said helium source with said sleeve assembly wherein said helium source pumps helium into said sleeve assembly to establish molecular conduction between said sleeve assembly and said cryocooler.

10. A sleeve assembly as recited in claim 1 wherein said cryocooler is a pulse tube, two stage cryocooler.

11. A sleeve for receiving a cryocooler having a cooling probe and a cooling element which comprises:

a heat transfer cylinder;

a heat transfer receptacle formed with a recess;

a wall interconnecting said heat transfer cylinder with said heat transfer receptacle to define a passageway therebetween;

a means for inserting said cryocooler into said sleeve to urge said cooling probe into said recess of said heat transfer receptacle to establish thermal communication therebetween and to position said cooling element in said heat transfer cylinder to establish thermal communication therebetween to set a temperature for said sleeve;

a bellows attached to said heat transfer cylinder and to said cryocooler to establish a collapsible chamber therebetween;

a means for disengaging said cryocooler from said sleeve to create said chamber as an enclosed space between said cryocooler and said sleeve to effectuate thermal insulation therebetween and to maintain said sleeve at substantially said temperature; and a helium source attached to said sleeve in fluid communication with said chamber.

12. A sleeve as recited in claim 11 wherein said heat transfer receptacle has an inner surface and an outer surface, said inner surface defining said recess and wherein said inner surface of said heat transfer receptacle is substantially in contact with said cooling probe of said cryocooler.

13. A sleeve as recited in claim 12 wherein said cooling probe is tapered and said inner surface of said heat transfer receptacle is tapered for mating engagement with said cooling probe.

14. A sleeve as recited in claim 11 wherein said heat transfer cylinder has an inner surface and an outer surface and wherein said cooling element of said cryocooler is positioned at a distance from said inner surface of said heat transfer cylinder, and further wherein said distance is in a range between approximately one thousandth of an inch to approximately five thousandths of an inch (0.001–0.005 inches).

15. A sleeve as recited in claim 11 further comprising:

a distal conductor attached to said outer surface of said heat transfer receptacle; and a proximal conductor attached to said outer surface of said heat transfer cylinder, wherein said distal conductor and said proximal conductor are each respectively connected in thermal communication with a superconducting device.

16. A sleeve as recited in claim 11 wherein said helium source pumps helium into said sleeve to establish molecular conduction between said sleeve and said cryocooler.

17. A sleeve as recited in claim 11 wherein said heat transfer cylinder and said heat transfer receptacle are made of copper and wherein said wall of said sleeve is made of stainless steel and further wherein said cryocooler is a pulse tube, two stage cryocooler and further wherein said cooling element and said cooling probe are made of copper.

* * * * *